US008087764B2

(12) United States Patent
Niimi

(10) Patent No.: US 8,087,764 B2
(45) Date of Patent: Jan. 3, 2012

(54) PRINTING APPARATUS

(75) Inventor: Akiko Niimi, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 380 days.

(21) Appl. No.: 12/382,928

(22) Filed: Mar. 26, 2009

(65) Prior Publication Data

US 2009/0244216 A1 Oct. 1, 2009

(30) Foreign Application Priority Data

Mar. 31, 2008 (JP) ..... 2008-093059

(51) Int. Cl.
*B41J 2/175* (2006.01)

(52) U.S. Cl. ..... 347/85

(58) Field of Classification Search ..... 347/2, 85–87
See application file for complete search history.

(56) References Cited

U.S. PATENT DOCUMENTS

| | | | | |
|---|---|---|---|---|
| 5,469,201 | A | 11/1995 | Erickson et al. | |
| 6,493,937 | B1 * | 12/2002 | Axtell et al. | 29/890.1 |
| 7,306,329 | B2 | 12/2007 | Watarai | |
| 2005/0162486 | A1 | 7/2005 | Watarai | |

FOREIGN PATENT DOCUMENTS

| | | |
|---|---|---|
| EP | 1 798 042 A1 | 6/2007 |
| JP | 4-278361 | 10/1992 |
| JP | 10-217496 | 8/1998 |
| JP | 2005-199506 | 7/2005 |
| JP | A-2005-199506 | 7/2005 |
| WO | WO 99/47356 | 9/1999 |

OTHER PUBLICATIONS

May 12, 2011 Office Action issued in European Patent Application No. 09156456.7.

* cited by examiner

*Primary Examiner* — Matthew Luu
*Assistant Examiner* — Lisa Solomon
(74) *Attorney, Agent, or Firm* — Oliff & Berridge, PLC

(57) ABSTRACT

A printing apparatus to form an image on a recording medium is provided. The printing apparatus includes a first recording head, which is movable in a main scanning direction and ejects a specific-colored ink onto the recording medium, a first ink cartridge to store the specific-colored ink, a first ink conveyer, which connects the first recording head and the first ink cartridge to convey the specific-colored ink, and a first conveyer retainer, which is movable along with the first recording head and holds the first ink conveyer to extend there-along. The first conveyer retainer is arranged in a position higher than a connecting portion of the first ink conveyer with the first recording head and holds the first ink conveyer in a vertical range between a top level of the first conveyer retainer and a bottom level of the first ink cartridge.

12 Claims, 5 Drawing Sheets

FIG. 5A
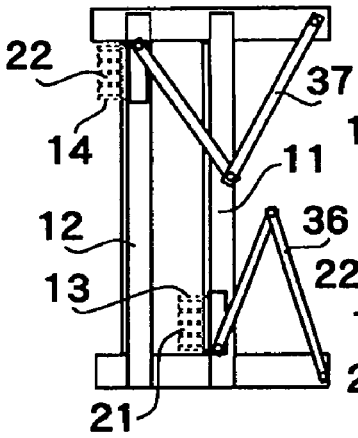
FIG. 5B
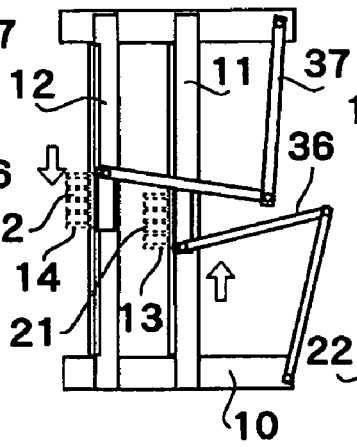
FIG. 5C
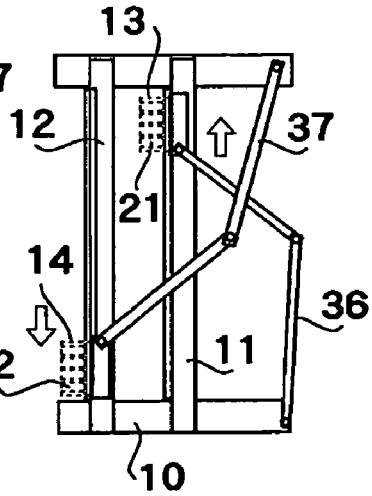
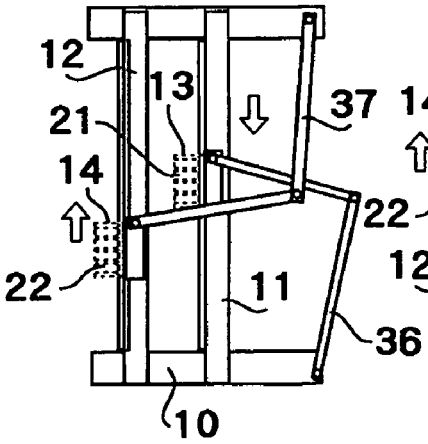
FIG. 5D
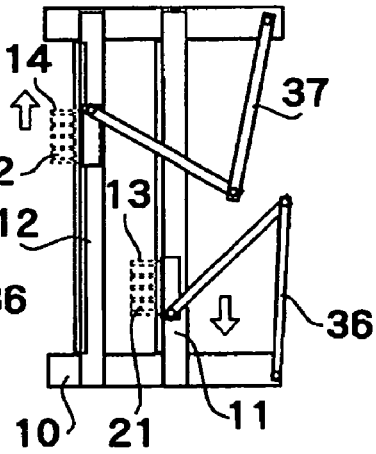
FIG. 5E

PRINTING APPARATUS

CROSS REFERENCE TO RELATED APPLICATION

This application claims priority from Japanese Patent Application No. 2008-093059, filed on Mar. 31, 2008, the entire subject matter of which is incorporated herein by reference.

BACKGROUND

1. Technical Field

An aspect of the present invention relates to a printing apparatus, specifically to a printing apparatus having a print head for ejecting white ink, an ink supplying system for the white ink, and an ink supplying system retainer.

2. Related Art

Conventionally, an inkjet printer to form an image in colors has been suggested. One example of such an inkjet printer is disclosed in Japanese Patent Provisional Publication No. 2005-199506. According to the above publication, the inkjet printer is configured such that the tubes to supply colored inks from ink cartridges to the inkjet heads are supported by retainer members, which are mounted on carriages to drive the inkjet heads, and guided by guiding members, which are located rear sides of the carriages. According to this configuration, postures of the tubes extending from the guide members to the inkjet heads are maintained to be substantially steady so that pressure to the inks in the tubes can be less fluctuated. Additionally, with the ink cartridges being fixed to the body of the inkjet printer, the carriages can be driven in smaller space in the inkjet printer to carry the inkjet heads.

In the above inkjet printer, however, the retainer members are arranged in positions higher than the carriages; therefore, level differences between portions of the tubes being held by the retainer members and connecting positions of the inkjet heads and the tubes and between the portions of the tubes being held by the retainer members and portions of the tubes at the guide members can be large.

SUMMARY

It is to be noted that CMYK (cyan, magenta, yellow, and black) colored inks can be used without difficulties over such level differences. However, W (white) ink, containing oxidized titanium and therefore having higher density of colorant with respect to densities of colorants in the other colored inks, and a particle size thereof being larger, can easily settle out in the tubes.

Accordingly, the densities of the white ink may vary within the tube, and troubles such as irregular ejection of the ink from the inkjet head, insufficient flow of the ink flow to the inkjet head, or uneven densities of the color in a formed image can be caused due to the uneven distribution of the ink within the tube.

In view of the above drawbacks, the present invention is advantageous in that a printing apparatus, in which unevenness of the white ink in the tube can be reduced and concentration gradient of the white ink within the tube can be smaller, is provided.

According to an aspect of the present invention, a printing apparatus to form an image on a recording medium, including a first recording head, which is movable in a main scanning direction of the printing apparatus and ejects a specific-colored ink onto the recording medium, a first ink cartridge to store the specific-colored ink, a first ink conveyer, which connects the first recording head and the first ink cartridge to convey the specific-colored ink from the first ink cartridge to the first recording head, and a first conveyer retainer, which is movable along with the first recording head and holds the first ink conveyer to extend there-along is provided. The first conveyer retainer is arranged in a position higher than a connecting portion of the first ink conveyer with the first recording head and holds the first ink conveyer in a vertical range between a top level of the first conveyer retainer and a bottom level of the first ink cartridge.

According to the above configuration, entire height of the first ink conveyer can be minimized, and the first ink conveyer can be maintained in a horizontally close range. Therefore, concentration gradient of the specific-colored ink within the first ink conveyer can be smaller.

BRIEF DESCRIPTION OF THE ACCOMPANYING DRAWINGS

FIGS. 5A-5E are schematic top views of the inkjet printer to illustrate movements of an ink supplier holder in the inkjet printer 1 according to the embodiment of the present invention.

DETAILED DESCRIPTION

Figure 1:
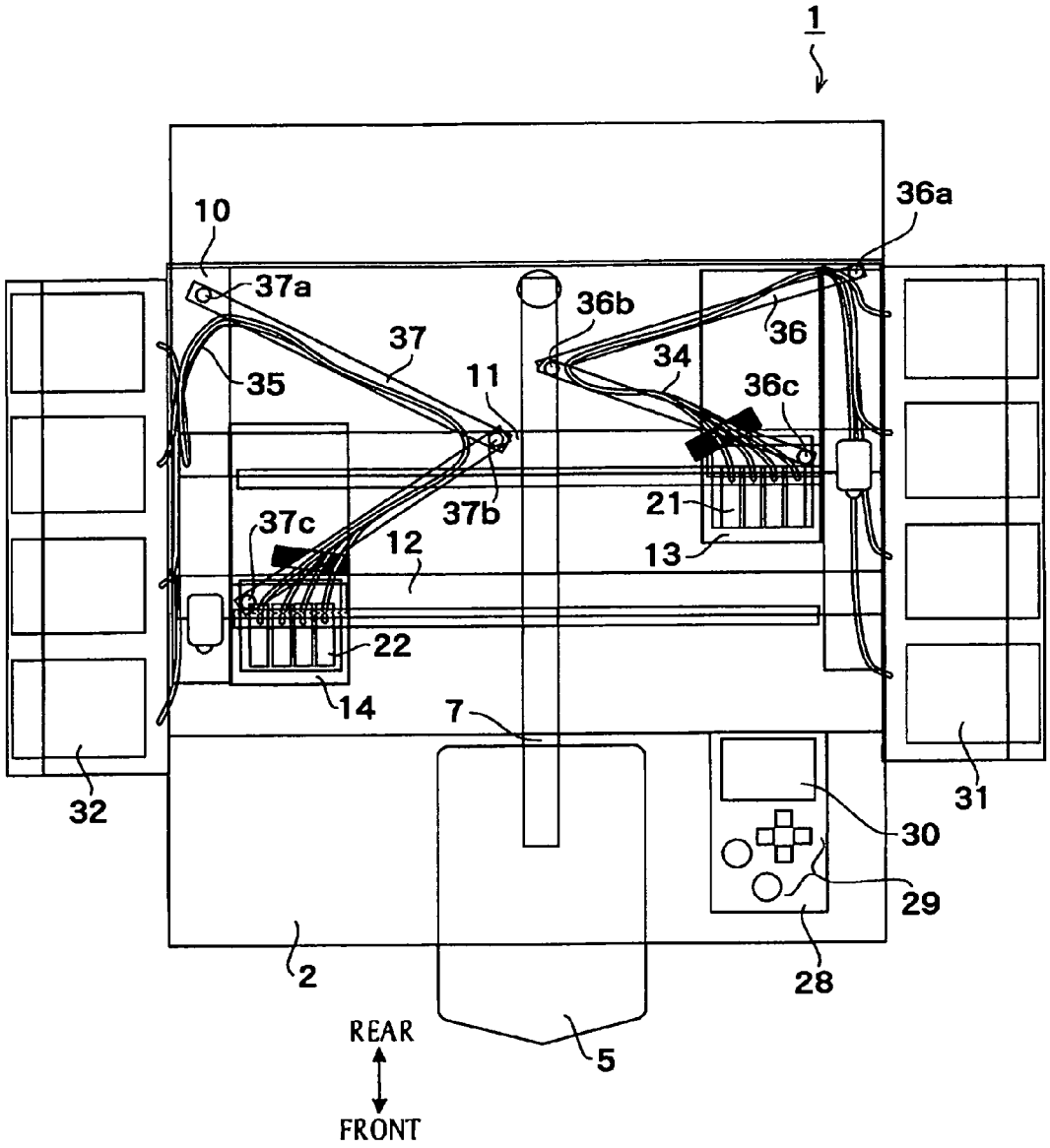
FIG. 1 is a plane view of an inkjet printer according to an embodiment of the present invention.
Figure 2:
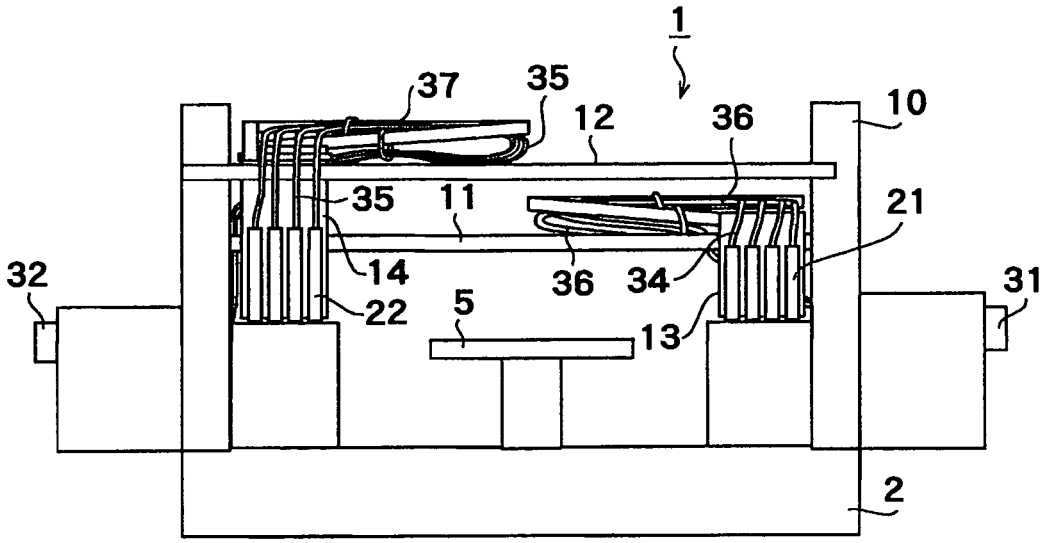
FIG. 2 is a front view of the inkjet printer according to the embodiment of the present invention.
Figure 3:
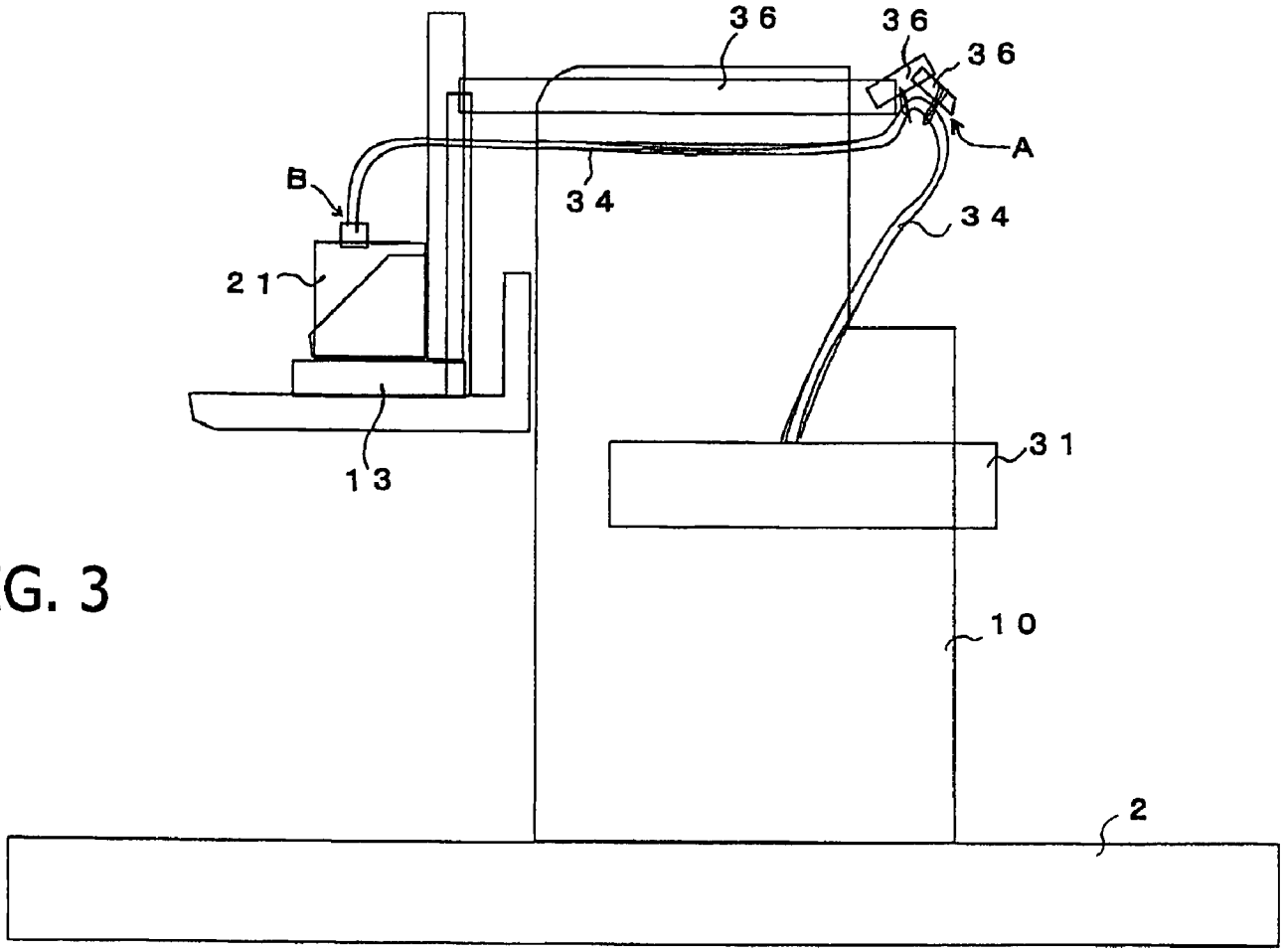
FIG. 3 is a side view of the inkjet printer according to the embodiment of the present invention.
Figure 4:
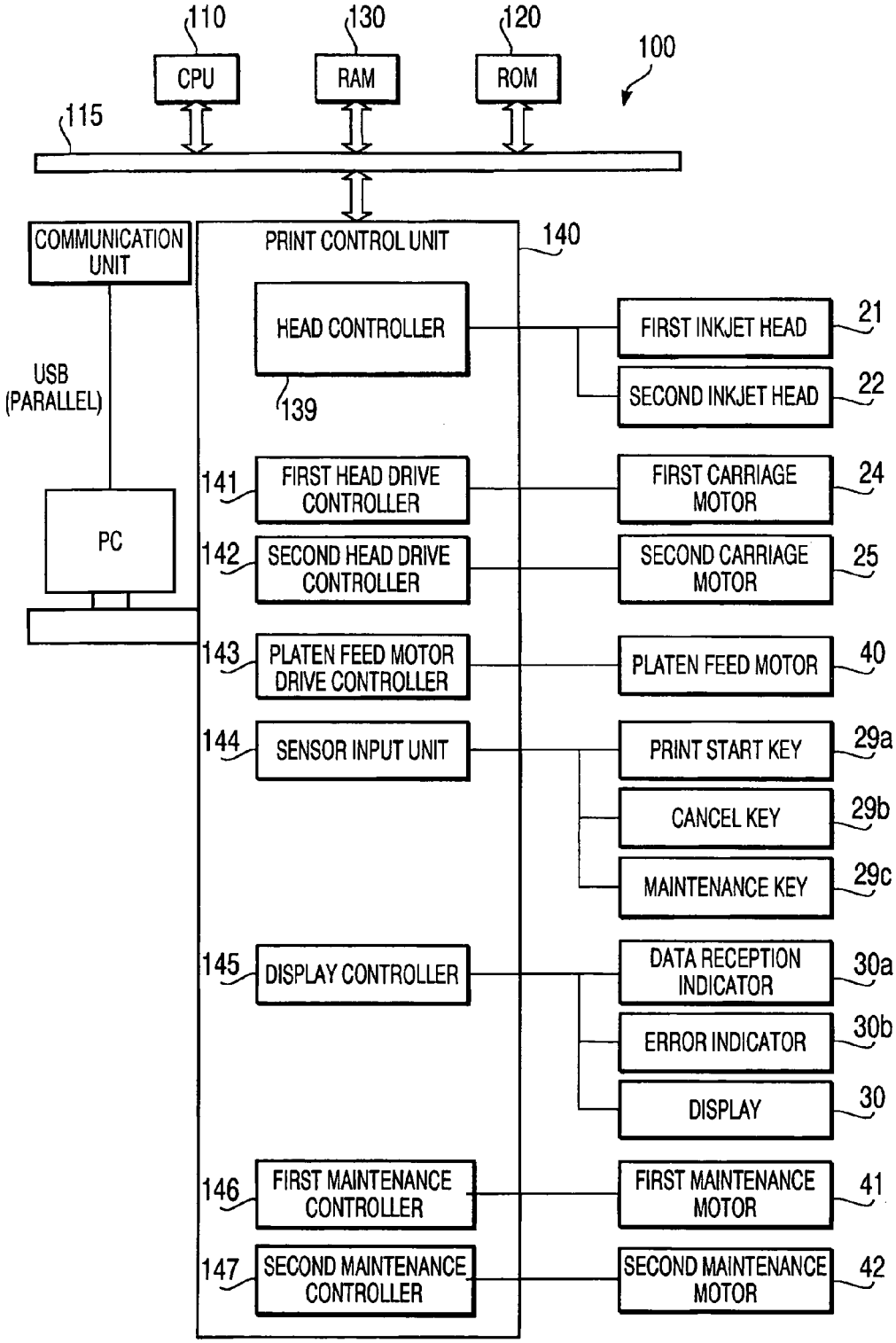
FIG. 4 is a block diagram to illustrate an electrical configuration of the inkjet printer according to the embodiment of the present invention.

Hereinafter, an embodiment according to an aspect of the present invention will be described with reference to the accompanying drawings. FIG. 1 is a plane view of an inkjet printer 1 according to the embodiment of the present invention. FIG. 2 is a front view of the inkjet printer 1 according to the embodiment of the present invention. FIG. 3 is a side view of the inkjet printer 1 according to the embodiment of the present invention. FIG. 4 is a block diagram to illustrate an electrical configuration of the inkjet printer 1 according to the embodiment of the present invention. FIGS. 5A-5E are schematic top views of the inkjet printer 1 to illustrate movements of an ink supplier holder in the inkjet printer 1 according to the embodiment of the present invention.

The inkjet printer 1 in the present embodiment is configured to be a known inkjet printer having first inkjet heads 21 and second inkjet heads 22 to form an image on a recording medium in inks ejected from nozzle surfaces of the first and the second inkjet heads 21, 22 according to image data. In the inkjet printer 1, a piece of fabric can be used as a recording medium, and the piece of fabric may be, for example, a T-shirt. As shown in FIGS. 1 and 2, the inkjet printer 1 is provided with a flat base plate 2 at a bottom and a chassis 10 to cover the entire body of the inkjet printer 1.

The first inkjet heads 21 are mounted on a carriage 13, which is reciprocated in a right-and-left direction in FIG. 1 along a guide rail 11. In the vicinity of a right-hand end of the guide rail 11, a first carriage motor 24 (FIG. 4) to carry the first inkjet heads 21 is provided. Further, a pulley (not shown) is provided in the vicinity of a left-hand end of the guide rail 11, and a carriage belt (not shown) is drawn between the first carriage motor 24 and the pulley. The carriage belt is fixed to the carriage 13 so that the carriage 13 is reciprocated along the guide rail 11 in the right-and-left direction (i.e., the main scanning direction) when the first carriage motor 24 is activated. At one of the right-hand end and the left-hand end of the reciprocative range of the carriage 13, a maintenance mechanism (not shown) such as a capping unit and a purge unit for the first inkjet heads 21 is provided.

On the right-hand end of the chassis 10, first ink cartridges 31 containing white ink therein are detachably attached. The first ink cartridges 31 are connected to each of the inkjet heads 21 by flexible ink conveyer tubes 34 so that the inks stored in the first ink cartridges 31 are conveyed to each channel of the inkjet heads 21. According to the present embodiment, all of the inkjet heads 21 are provided to discharge white ink therefrom, and the first ink cartridges 31 respectively contain white ink.

The ink conveyer tubes 34 to supply the ink to the first inkjet heads 21 are moved along with first inkjet heads 21 when the carriage 13 with the first inkjet heads 21 is reciprocated in the main scanning direction. Therefore, the ink conveyer tubes 34 are formed to be longer than a length of the guide rail 11. The ink conveyer tubes 34 with the length are held by a first arm 36 to extend there-along so that the ink conveyer tubes 34 can smoothly move to follow the carriage 13.

The first arm 36 includes a rear portion, which is a thin and elongated plate rotatable about a supporting point 36*a*, and a supporting point 36*b* is provided at an end of the rear portion. The first arm 36 further includes a front portion, which is a thin and elongated plate rotatable about the supporting point 36*b* and is coupled to the carriage 13 at a supporting point 36*c*. Movements of the first arm 36 will be described hereinbelow with reference to FIGS. 5A-5E.

When the carriage 13 is at the left end on the guide rail 11, as shown in FIG. 5A, an interior angle between the rear portion and the front portion of the first arm 36 is an acute angle. As the carriage 13 is driven toward the left-hand side of the inkjet printer 1 in a direction indicated by an upper arrow (i.e., toward the upper side in FIG. 5B), the front portion and the rear portion of the first arm 36 are rotated about the supporting point 36*b* and the supporting point 36*a* respectively, and the interior angle between the front portion and the rear portion transits to be widened. When the carriage 13 is moved to the left-hand end (i.e., the upper end in FIG. 5C), the interior angle between the front portion and the rear portion of the first arm 36 becomes an obtuse angle. Thereafter, when the carriage 13 makes a turn at the left-hand end of the guide rail 11 and returns in a direction indicated by downward arrows in FIGS. 5D and 5E (i.e., toward the lower side), the interior angle between the front portion and the rear portion of the first arm 36 becomes acute once again as shown in FIG. 5E. As shown in FIGS. 1 and 2, the ink conveyer tubes 34 are bound up to the first arm 36 at portions corresponding to the front portion and the rear portion respectively. Therefore, throughout these movements shown in FIGS. 5A-5E, horizontal levels of the front portion and the rear portion of the first arm 36 are maintained substantially steady in a same horizontal plane. Features of arrangement of the first arm 36 and the ink conveyer tubes 34 will be described later in detail.

The inkjet printer 1 according to the embodiment is equipped with a guide rail 12 (FIG. 1), which is arranged in parallel with the guide rail 11, to guide a carriage 14 with a second inkjet head 22 being mounted. As shown in FIG. 2, the guide rail 12 is arranged in a position higher than the guide rail 11.

In the vicinity of a left-hand end of the guide rail 12, a second carriage motor 25 (FIG. 4) to carry the second inkjet heads 22 is provided. Further, a pulley (not shown) is provided in the vicinity of the right-hand end of the guide rail 12, and a carriage belt (not shown) is drawn between the second carriage motor 25 and the pulley. The carriage belt is fixed to the carriage 14 so that the carriage 14 is reciprocated along the guide rail 12 in the left-and-right direction (i.e., the main scanning direction) when the second carriage motor 25 is activated. At one of the right-hand end and the left-hand end of the reciprocative range of the carriage 14, a maintenance mechanism (not shown) such as a capping unit and a purge unit for the second inkjet heads 22 is provided.

On the left-hand end of the chassis 10, second ink cartridges 32 containing CMYK inks respectively therein are detachably attached. The second ink cartridges 32 are connected to each of the inkjet heads 22 by flexible ink conveyer tubes 35 so that the inks stored in the second ink cartridges 32 are conveyed to each channel of the inkjet heads 22.

The ink conveyer tubes 35 to supply the ink to the second inkjet heads 22 are moved along with second inkjet heads 22 when the carriage 14 with the second inkjet heads 22 is reciprocated in the main scanning direction. Therefore, the ink conveyer tubes 35 are formed to be longer than a length of the guide rail 12. The ink conveyer tubes 35 with the length are held by a second arm 37 to extend there-along so that the ink conveyer tubes 35 can smoothly move to follow the carriage 14.

The second arm 37 includes a rear portion, which is a thin and elongated plate, rotatable about a supporting point 37*a*, and a supporting point 37*b* is provided at an end of the rear portion. The second arm 37 further includes a front portion, which is a thin and elongated plate, rotatable about the supporting point 37*b* and is coupled to the carriage 14 at a supporting point 37*c*. Movements of the second arm 37 with the ink conveyer tubes 35 are, as shown in FIGS. 5A-5E, similar but only bilaterally symmetrical to the movements of the first arm 36 with the ink conveyer tubes 36 as described above. Therefore, description of the movements of the second arm 37 with the ink conveyer tubes 35 are omitted herein.

As shown in FIGS. 1 and 2, the ink conveyer tubes 35 are bound up to the second arm 37 at portions corresponding to the front portion and the rear portion respectively. Therefore, throughout the movements shown in FIGS. 5A-5E, horizontal levels of the front portion and the rear portion of the second arm 37 are maintained substantially steady in a same horizontal plane.

It is to be noted that the guide rail 12 is arranged in the position vertically higher than the guide rail 11; therefore, movements of the first arm 36 and the second arm 37 as shown in FIGS. 5A-5E do not interfere each other even when the second arm 37 moves to cross over the first arm 36.

The inkjet printer 1 is equipped with a platen 5. The platen 5 is formed to have a substantially rectangular-shaped plate, on which the recording medium (e.g., a T-shirt) is placed in a printable posture in the inkjet printer 1. The platen 5 is supported by a platen feed unit 7, which includes a guide rail (not shown) and a platen feed motor 40 (FIG. 4) being a stepping motor arranged at a rear end portion (i.e., upper end in FIG. 1) of the guide rail. When the platen feed motor 40 is activated, the platen 5 is reciprocated along the guide rail in the front-and-rear direction (i.e., up-and-down direction) in FIG. 1. The inkjet printer 1 may have a plurality of sizes of platen 5, which can be selected according to, for example, sizes and shapes of the recording media.

At right-hand front of the inkjet printer 1 is provided an operation panel 28, through which a user inputs an instruction for the inkjet printer 1. The operation panel 28 includes print buttons 29 and a display 30.

Next, referring to FIG. 4, an electrical configuration of the inkjet printer 1 will be described. FIG. 4 is a block diagram showing the electrical configuration of the inkjet printer 1 according to the present embodiment of the invention. As shown in FIG. 4, the inkjet printer 1 is provided with a control unit 100, and the control unit 100 includes a CPU 110 that controls the entire operation in the inkjet printer 1. The CPU 110 is connected with a ROM 120, a RAM 130 through a bus 115. The ROM 120 stores various controlling programs to be executed in the CPU 110. The RAM 130 temporarily stores data concerning the operations in the inkjet printer 1.

A print control unit 140 includes a head controller 139, which drives piezoelectric actuators for each of the channels in the first inkjet heads 21 and the second inkjet heads 22. The print control unit 140 further includes a first head drive controller 141 to activate the first carriage motor 24, a second head drive controller 142 to activate the second carriage motor 25, and a platen feed motor controller 143 to activate the platen feed motor 40.

The print control unit 140 further includes a sensor input unit 144, which receives input signals provided from a print start key 29*a*, a cancel key 29*b*, and a maintenance key 29*c*. The print start key 29*a*, the cancel key 29*b*, and the maintenance key 29*c* are provided on the operation panel 28. The operation panel 28 further includes a data reception indicator 30*a*, an error indicator 30*b*, and the display 30, which are controlled by a display control unit 145.

The inkjet printer 1 in the present embedment includes a first maintenance mechanism and a second maintenance mechanism respectively on either (right or left) side of the guide rail 11 and the guide rail 12. The first and the second maintenance mechanisms serve to maintain operating conditions of the first inkjet heads 21 and the second inkjet heads 22 respectively. The first maintenance mechanism includes a first maintenance motor 41, and the second maintenance mechanism includes a second maintenance motor 42. The print control unit 140 is provided with a first maintenance controller 146 to activate the first maintenance motor 41 and a second maintenance controller 147 to activate the second maintenance motor 42.

Next, arrangement of the ink conveyer tubes 34 to supply white ink to the first inkjet heads 21 according to the embodiment of the present invention will be described. The inkjet printer 1 in the present embodiment is equipped with the first inkjet heads 21 to eject white ink and the second inkjet heads 22 to eject CMYK colored inks. As has been described above, the white ink contains oxidized titanium and has higher density of pigment with respect to densities of pigments in the other colored inks; therefore, a particle size of the white ink is larger. In consideration of these features of the white ink, the inkjet printer 1 is configured such that the vertical level of the ink conveyer tubes 34 for the white ink is substantially constant to be in a horizontal plane throughout the length between the first cartridges 31 and the first inkjet heads 21.

More specifically, as shown in FIG. 3, segments of the ink conveyer tubes 34 between a bound portion A, in which the ink conveyer tubes 34 are bound to the first arm 36, and a connected portion B, in which the ink conveyer tubes 34 are connected to the first inkjet heads 21, are held in substantially an even level by the first arm 36. Therefore, the ink conveyer tubes 34 can be maintained within the same horizontal plane regardless of the operating motions of the first inkjet heads 21.

It is to be noted, in FIG. 1, the ink conveyer tubes 34 being held by the first arm 36 are indicated in solid lines for simplicity in description; however, in the present embodiment, the ink conveyer tubes 34 are held along a downward surface of the first arm 36.

Further, as shown in FIG. 3, the ink conveyer tubes 34 are arranged within a vertical range between a top surface of the first arm 36 and a bottom level of the first cartridges 31 so that the level differences to be caused in the ink conveyer tubes 34 can be maintained small.

Furthermore, as shown in FIG. 2, the first arm 36 to hold the ink conveyer tubes 34 for the white ink are in a lower position than the second arm 37 to hold the ink conveyer tubes 35 for the CMYK colored inks. Therefore, the level differences which may be caused in the ink conveyer tubes 34 can be maintained to be smaller than the level differences which may be caused in the ink conveyer tubes 35. Because the first arm 36 is arranged in the lower position than the second arm 37, a length in the ink conveyer tubes 34 from the first cartridges 31 to the first inkjet heads 21 can be shorter than a length in the ink conveyer tubes 35 from the second cartridges 32 to the second inkjet heads 22 so that the distance in which the white ink travels within the ink conveyer tubes 34 can be shorter.

According to the above configuration, uneven distribution of the white ink in the ink conveyer tubes 34 can be reduced even when the white ink contains oxidized titanium and therefore has higher density of pigment with respect to densities of pigments in the other colored inks. Thus, uneven concentration of the colorants can be prevented from occurring, and concentration gradient of the white ink within the ink conveyer tubes can be smaller. Accordingly, irregular ejection of the white ink from the first inkjet heads 21, insufficient flow of the ink flow to the first inkjet heads 21, or uneven densities of the color in a formed image can be prevented.

Additionally, in the present embodiment, the first arm 36 to hold the first inkjet heads 21 for white ink and the second arm 37 to hold the second inkjet heads 22 for CMYK colored inks are separately arranged in the respective (right or left) sides within the chassis 10; therefore, even without the guide rails 11, 12 being not separated apart from each other, the ink conveyer tubes 34 and 35 can be prevented from interfering each other when the carriages 13 and 14 are respectively driven.

When an image is printed in the inkjet printer 1 according to the embodiment, and the first and the second arms 36, 37 are operated as shown in FIGS. 5A-5E, the recording medium is fed from the rear side toward the front side of the inkjet printer 1 (i.e., from the right-hand side toward the left-hand side in FIGS. 5A-5E). Simultaneously, the carriage 13 is moved from the lower side to the upper side in FIGS. 5A-5E, and the carriage 14 is moved from the upper side to the lower side in FIGS. 5A-5E. Therefore, the image is formed on the recording medium firstly in the white ink and in the CMYK inks thereafter over the white layer. During the above operation shown in FIGS. 5B and 5C, the second arm 37 crosses over the first arm 36 in the plan views; however the first arm 36 and the second arm 37 are arranged in vertically different levels so that the ink conveyer tubes 34 and 35 do not interfere each other.

Although an example of carrying out the invention has been described, those skilled in the art will appreciate that there are numerous variations and permutations of the printing apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

In the above embodiment, the first and the second arms 36, 37 include two-segmented portions; however, the arms may include more than two segments as long as each of the arms are deformable according to movements of the inkjet heads 21, 22 within a same horizontal plane. For example, the arms may be extended and contracted in a caterpillar style or an accordion-folded style.

What is claimed is:

1. A printing apparatus to form an image on a recording medium, comprising:

a first recording head, which is movable in a main scanning direction of the printing apparatus and ejects a specific-colored ink onto the recording medium;

a first ink cartridge to store the specific-colored ink;

a first ink conveyer, which connects the first recording head and the first ink cartridge to convey the specific-colored ink from the first ink cartridge to the first recording head;

a first conveyer retainer, which is movable along with the first recording head and holds the first ink conveyer to extend there-along;

a second recording head, which is movable in the main scanning direction of the printing apparatus and ejects other colored ink in a color other than the specific color onto the recording medium;

a second ink cartridge to store the other colored ink;

a second ink conveyer, which connects the second recording head and the second ink cartridge to convey the other colored ink from the second ink cartridge to the second recording head; and a second conveyer retainer, which holds the second ink conveyer to extend there-along;

wherein:

the first conveyer retainer is arranged in a position higher than a connecting portion of the first ink conveyer with the first recording head and lower than the second conveyer retainer; and the first conveyer retainer holds the first ink conveyer in a vertical range between a top level of the first conveyer retainer and a bottom level of the first ink cartridge.

2. The printing apparatus according to claim 1, wherein the first conveyer retainer is formed to have a flat retainer surface to hold the first ink conveyer at least by a part, ranging between a bound portion in which the first ink conveyer is bound to the first conveyer retainer and the connecting portion of the first ink conveyer being connected to the first recording head.

3. The printing apparatus according to claim 2, wherein the flat retainer surface of the first conveyer retainer is arranged to be substantially horizontal.

4. The printing apparatus according to claim 1, wherein a length of the first ink conveyer to convey the specific-colored ink to the first recording head is shorter than a length of the second ink conveyer to convey the other colored ink.

5. The printing apparatus according to claim 1, wherein a density of a colorant in the specific-colored ink is higher than a density of a colorant in the other colored ink.

6. The printing apparatus according to claim 1, wherein a particle size of a colorant in the specific-colored ink is larger than a particle size of a colorant in the other colored ink.

7. The printing apparatus according to claim 1, wherein the second ink conveyer is a flexible tube.

8. The printing apparatus according to claim 1, wherein the first ink conveyer is a flexible tube.

9. The printing apparatus according to claim 1, wherein the specific-colored ink is a white-colored ink containing oxidized titanium.

10. The printing apparatus according to claim 1, comprising a first head drive unit to drive the first recording head in the main scanning direction, wherein, when the first recording head is driven in the main scanning direction, the first conveyer retainer maintains the first ink conveyer following the first recording head to be substantially horizontal within in a same horizontal plane.

11. The printing apparatus according to claim 1, wherein the first conveyer retainer is deformable within a substantially same horizontal plane according to movements of the first recording head.

12. The printing apparatus according to claim 11, wherein the first ink conveyer is deformable within a substantially same horizontal plane according to deformation of the first conveyer retainer.

* * * * *